US011951546B2

(12) United States Patent
Sobu

(10) Patent No.: US 11,951,546 B2
(45) Date of Patent: Apr. 9, 2024

(54) OXIDATION RESISTANT ALLOY AND MANUFACTURING METHOD OF OXIDATION RESISTANT ALLOY

(71) Applicant: MITSUBISHI HEAVY INDUSTRIES, LTD., Tokyo (JP)

(72) Inventor: Shintaro Sobu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 31 days.

(21) Appl. No.: 17/632,650

(22) PCT Filed: Jan. 20, 2021

(86) PCT No.: PCT/JP2021/001863
§ 371 (c)(1),
(2) Date: Feb. 3, 2022

(87) PCT Pub. No.: WO2021/192554
PCT Pub. Date: Sep. 30, 2021

(65) Prior Publication Data

US 2022/0274168 A1 Sep. 1, 2022

(30) Foreign Application Priority Data

Mar. 27, 2020 (JP) ..... 2020-057413

(51) Int. Cl.
*B22F 3/15* (2006.01)
*B22F 3/02* (2006.01)

(52) U.S. Cl.
CPC ..... *B22F 3/15* (2013.01); *B22F 3/02* (2013.01); *B22F 2301/20* (2013.01)

(58) Field of Classification Search
CPC ..... B22F 3/15; B22F 3/16; B22F 7/02; B22F 3/004; B22F 7/06; B22F 3/02; B22F 3/225; B22F 5/00; B22F 7/062
See application file for complete search history.

(56) References Cited

U.S. PATENT DOCUMENTS 5,595,616 A 1/1997 Berczik
5,693,156 A 12/1997 Berczik
(Continued)

FOREIGN PATENT DOCUMENTS

EP 0 538 073 4/1993
EP 1 295 657 3/2003
(Continued)

OTHER PUBLICATIONS

International Search Report dated Mar. 23, 2021 in International (PCT) Application No. PCT/JP2021/001863.
(Continued)

*Primary Examiner* — Ricardo D Morales
(74) *Attorney, Agent, or Firm* — Wenderoth, Lind & Ponack, L.L.P.

(57) ABSTRACT

A manufacturing method of oxidation resistant alloy includes: producing a first formed member by applying compression forming to metal powder; and applying compression forming to the first formed member in a state in which the first formed member is covered with alloy powder different from the metal powder. The oxidation resistance of the major constituent of the alloy powder is higher than the oxidation resistance of the major constituent of the metal powder. Producing the first formed member may include applying the compression forming to the metal powder without melting the metal powder. Applying the compression forming to the first formed member may include: producing a second formed member by applying compression forming to the alloy powder without melting the alloy powder; and sintering the second formed member.

10 Claims, 8 Drawing Sheets

(56) References Cited

U.S. PATENT DOCUMENTS

| | | | | |
|---|---|---|---|---|
| 2003/0070732 | A1 | 4/2003 | Lin | |
| 2004/0071581 | A1* | 4/2004 | Lim | B21C 3/02 419/36 |
| 2011/0195265 | A1 | 8/2011 | Oohira et al. | |
| 2013/0071627 | A1 | 3/2013 | Archer | |
| 2014/0356646 | A1* | 12/2014 | Schmidt | H01B 13/0036 428/673 |
| 2014/0361208 | A1 | 12/2014 | Tsuji et al. | |
| 2017/0088939 | A1 | 3/2017 | Rachbauer et al. | |

FOREIGN PATENT DOCUMENTS

| | | |
|---|---|---|
| JP | 43-022484 | 9/1968 |
| JP | 61-142672 | 6/1986 |
| JP | 62-174302 | 7/1987 |
| JP | 3-232906 | 10/1991 |
| JP | 05-320717 | 12/1993 |
| JP | 05320717 A * | 12/1993 |
| JP | 07-003306 | 1/1995 |
| JP | 10-512329 | 11/1998 |
| JP | 2002-194474 | 7/2002 |
| JP | 2004-115833 | 4/2004 |
| JP | 2004-538359 | 12/2004 |
| JP | 2010-106311 | 5/2010 |
| JP | 2013-515852 | 5/2013 |
| JP | 2014-531700 | 11/2014 |
| JP | 2014-238143 | 12/2014 |
| JP | 2017-524805 | 8/2017 |
| JP | 2019-210184 | 12/2019 |

OTHER PUBLICATIONS

Translation of the International Preliminary Report on Patentability dated Oct. 6, 2022 in International Application No. PCT/JP2021/001863.

Extended European Search Report dated Aug. 5, 2022 in corresponding European Patent Application No. 21775074.4.

A. Lange et al., "Oxidation behavior of magnetron sputtered double layer coatings containing molybdenum, silicon and boron", Intermetallics, Elsevier Science Publishers B.V., GB, vol. 48, Oct. 1, 2013, pp. 19-27.

Linfen Su et al., "An ultra-high temperature Mo—Si—B based coating for oxidation protection of $Nb_{ss}/Nb_5Si_3$ composites", Applied Surface Science, Elsevier, Amsterdam, NL, vol. 337, Feb. 16, 2015, pp. 38-44.

* cited by examiner

OXIDATION RESISTANT ALLOY AND MANUFACTURING METHOD OF OXIDATION RESISTANT ALLOY

TECHNICAL FIELD

The present invention relates to oxidation resistant alloy and a manufacturing method of oxidation resistant alloy.

BACKGROUND

Researches of alloys with high oxidation resistance have been conducted. For example, patent literature 1 discloses a method of manufacturing molybdenum alloy with oxidation resistance by adding boride silicide of molybdenum or molybdenum alloy.

Patent literature 2 discloses a technology for forming a coating with molybdenum-silicon-boron (Mo—Si—B) based alloy through a plasma spraying method.

Patent literature 3 discloses a technology for forming a coating with molybdenum-silicon-boron (Mo—Si—B) based alloy through sputtering.

PRIOR ART LITERATURE

Patent Literature

Patent literature 1: JP H10-512329 A
Patent literature 2: JP 2004-115833 A
Patent literature 3: JP 2017-524805 A

SUMMARY

In view of the above-described circumstances, one objective is to provide oxidation resistant alloy. Other objectives would be understood from the following recitation and description of embodiments.

In one embodiment for achieving the above-described objectives, a manufacture method of oxidation resistant alloy includes: producing a first formed member by applying compression forming to metal powder; and applying compression forming to the first formed member in a state in which the first formed member is covered with alloy powder different from the metal powder. The oxidation resistance of the major constituent of the alloy powder is higher than the oxidation resistance of the major constituent of the metal powder.

In one embodiment for achieving the above-described objectives, oxidation resistant alloy includes: an inner structure that includes first metal as a main constituent; and an outer structure that includes an element that forms compound with the first metal, the outer structure covering the inner structure. In the outer structure, the distribution of the element that forms the compound with the first metal is even in a thickness direction of the outer structure. The concentration of the compound of the first metal in the outer structure is different from the concentration of the compound of the first metal in the inner structure. The outer structure has a plurality of voids with aspect ratios of 1.3 or less.

The above-described embodiments enable manufacture of oxidation resistant alloy.

DETAILED DESCRIPTION

Embodiment 1

Figure 1:
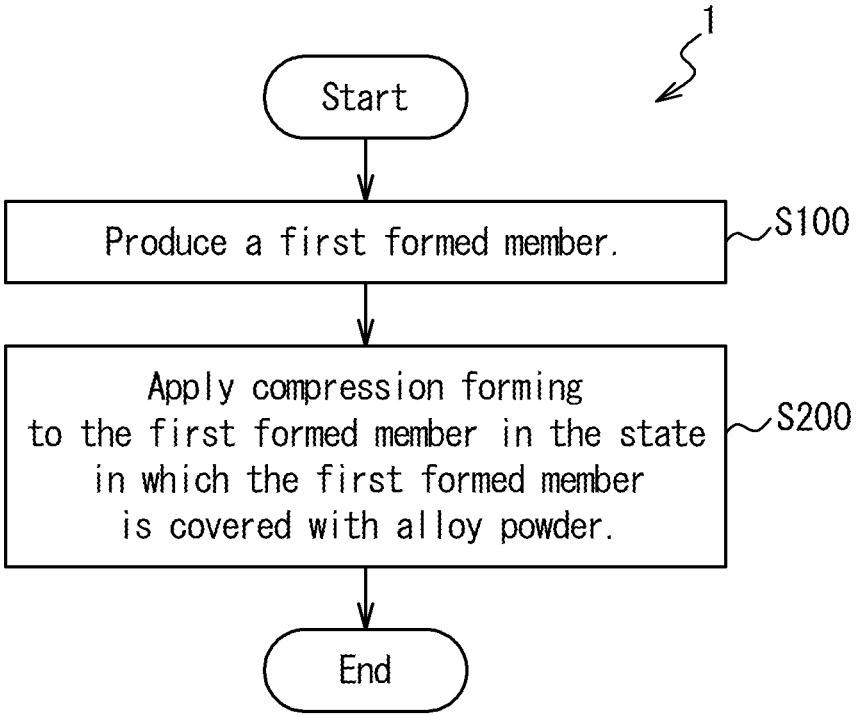
FIG. 1 is a flowchart showing a manufacturing method of oxidation resistant alloy, according to one embodiment.

A manufacturing method 1 shown in FIG. 1 enables manufacture of oxidation resistant alloy with a reduced cost. At step S100, a first formed member 100 is produced by applying compression forming to metal powder. The main constitute of the metal powder includes any metal, such as molybdenum (Mo), niobium (Nb), tungsten (W), metal-silicon-based alloy, metal-boron-based alloy, and the like. The metal contained in the metal-silicon-based alloy and the metal contained in the metal-boron-based alloy may include molybdenum (Mo), niobium (Nb), tungsten (W), or the like. Both the metal-silicon-based alloy and the metal-boron-based alloy may include metal-silicon-boron-based alloy. The metal-silicon-based alloy may include, for example, $Mo_5Si_3$, $Mo_3Si$, or the like, and the metal-boron-based alloy may include, for example, MoB, $Mo_2B$, or the like. The metal-silicon-boron-based alloy may include $Mo_5SiB_2$ or the like. The main constitute of the powder may include material that has the highest concentration (e.g., the highest mass percentage) in the powder.

The first formed member 100 may be produced by applying the compression forming to the metal powder without melting the metal powder. For example, the first formed member 100 may be formed through cold isostatic pressing (CIP). Alternatively, the first formed member 100 may be formed through molding that achieves compression forming in one direction (e.g., the vertical direction) with a metal mold. This may result in that the first formed member 100 is formed as a non-sintered body, which is not yet sintered.

At step 200, oxidation resistant alloy 300 is produced by applying compression forming to the first formed member 100 in the state in which the first formed member 100 is covered with alloy powder. The alloy powder is different from the metal powder contained in the first formed member 100. The main constitute of the alloy powder includes oxidation resistant alloy, for example, metal-silicon-boron-based alloy. The metal contained in the metal-silicon-boron-based alloy may include molybdenum (Mo), niobium (Nb), tungsten (W), or the like, and the metal-silicon-boron-based alloy may include $Mo_5SiB_2$, $Mo_5Si_3$, $Mo_3Si$, MoB, $Mo_2B$, or the like. The main constitute of the alloy powder may exhibit higher oxidation resistance than the main constitute of the metal powder contained in the first formed member 100.

The oxidation resistance may be measured as the thickness of the formed oxide from the surface or the decrease in the thickness of material (e.g., the amount of the thickness decrease of the material due to sublimation at the surface) when the material is placed in a space with a desired temperature (e.g., 1095° C.) for a desired time duration (e.g., two hours). The oxidation resistance is measured as higher as the thickness of the formed oxide is reduced or as the decrease in the thickness of the material is reduced.

Figure 2:
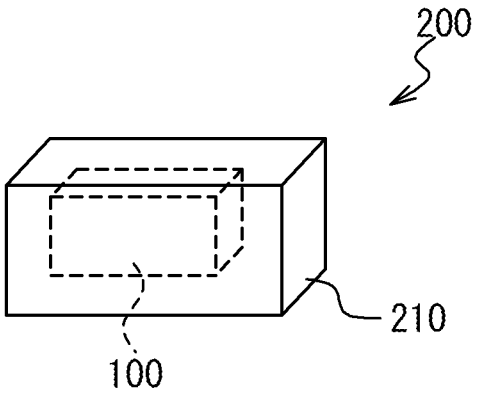
FIG. 2 is a schematic diagram of a second formed member, according to one embodiment.

At step S200, as shown in FIG. 2, a second formed member 200 may be produced by implementing the compression forming without melting the alloy powder. For example, the first formed member 100 is covered with the alloy powder. The first formed member 100 covered with the alloy powder is subjected to compression forming to produce the second formed member 200. The second formed member 200 includes an outer layer 210 that covers the first formed member 100 and is formed of the alloy powder. For example, the first formed member 100 may be entirely covered with the alloy powder. The second formed member 200 may be produced through cold isostatic pressing or molding from the first formed member 100 covered with the alloy powder. The mold used in the compression forming of step S200 may be different from the mold used in the compression forming of step S100.

Oxidation resistant alloy 300 may be produced by sintering the second formed member 200. The second formed member 200 may be sintered by any methods such as spark plasma sintering (SPS) and millimeter wave sintering. For example, the second formed member 200 may be sintered in a reducing atmosphere, for example, in hydrogen gas.

The second formed member 200 is sintered, for example, after being detached from the mold used for the compressing forming. The second formed member 200 is detached from the mold used for the compressing forming and placed on a floor plate jig. The floor plate jig is formed of metal suitable for the main constituent of the alloy powder. When the main constituent of the alloy powder is molybdenum compound, for example, the floor plate jig is formed of molybdenum or molybdenum compound. Further, a support jig is placed depending on the shape of the second formed member 200. The support jig suppresses deformation of the second formed member 200 during the sintering, for example, deformation caused by gravity.

Figure 3:
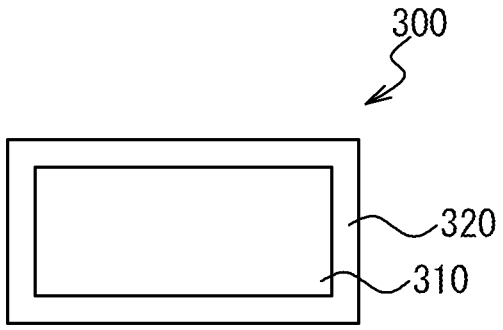
FIG. 3 is a section view of oxidation resistant alloy, according to one embodiment.

As shown in FIG. 3, the oxidation resistant alloy 300 includes an inner structure 310 and an outer structure 320. The inner structure 310 includes constituents corresponding to the constituents of the metal powder contained in the first formed member 100. For example, the main constituent of the inner structure 310 is the same as a constituent of the first formed member 100. Further, the outer structure 320 includes constituents corresponding to the constituents of the alloy powder that covered the first formed member 100. For example, the main constituent of the outer structure 320 is the same as a constituent of the alloy powder that covered the first formed member 100.

The surface of the oxidation resistant alloy 300 exhibits high oxidation resistance. The surface of the oxidation resistant alloy 300 is formed by the outer structure. The main constituent of the outer structure 320 includes oxidation resistant alloy that is the main constituent of the alloy powder. Accordingly, the oxidation resistant alloy 300 exhibits high oxidation resistance. Further, the oxidation resistant alloy 300 may also have ductility when the main constituent of the metal powder has ductility. The main constituent of the alloy (e.g., the main constituent of the outer structure 320) may include the material with the highest concentration (e.g., the highest mass percentage) in the alloy or include five materials with the highest five concentrations.

As thus described, since the oxidation resistant alloy 300 can be manufactured with a single sintering process, the manufacturing cost can be reduced. If oxidation resistant alloy is manufactured with coating, the surface is cleaned before the coating. The coating process and the cleaning process increase the manufacture cost compared to the manufacturing method 1. The cleaning process may involve surface processing for covering the internal structure with alloy powder, for example, removal of a surface denaturation layer.

The manufacturing method 1 allows omitting this cleaning process. In addition, since the oxidation resistant alloy 300 can be manufactured to have a near net shape similar to the product shape, the manufacturing cost can be further reduced.

At step S200, the first formed member 100 may be covered with the alloy powder such that the distribution of an element(s) contained in the main constituent of the alloy powder is even. In this case, the distribution of the element(s) contained in the main constituent of the outer structure 320 of the oxidation resistant alloy 300 manufactured by this method may be even. For example, the distribution of the element(s) contained in the main constituent of the outer structure 320 may be even in the thickness direction of the outer structure 320, not varying depending on the distance from the surface. A similar applies to the inner structure 310; the element(s) contained in the main constituent of the inner structure 310 may be evenly distributed.

Figure 4:
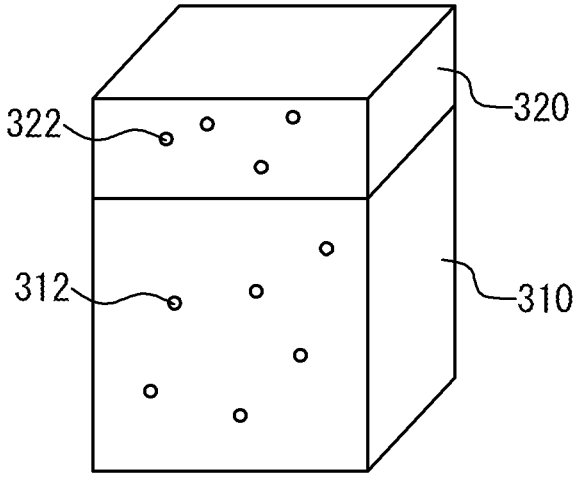
FIG. 4 is a diagram for illustrating the structure of oxidation resistant alloy, according to one embodiment.

Further, as shown in FIG. 4, since the alloy powder is subjected to compression forming and sintering, the outer structure 320 may have a plurality of substantially spherical voids 322 with aspect ratios of, for example, 1.3 or less. For example, 80% or more of the voids 322 have aspect ratios of 1.3 or less. The inner structure 310 may also have a plurality of substantially spherical voids 312 with aspect ratios of, for example, 1.3 or less. For example, 80% or more of the voids 312 have aspect ratios of 1.3 or less. The density of the outer structure 320 may be 90% or more. The density of the inner structure 310 may also be 90% or more.

The above-described structure may distinguish the oxidation resistant alloy 300 manufactured by the present method from alloy manufactured using a coating process. The even distribution may mean that the concentration of an element does not vary 10% or more.

The concentration of an element may be measured by an electron probe micro analyzer (EPMA). For example, element constituents are measured on a plurality of section surfaces of the inner structure 310 or the outer structure 320 with an electron probe micro analyzer. The element distributions may be measured in this way. The shapes of the voids 312 and 322, for example, the aspect ratios, may be measured by capturing images of section surfaces of the inner structure 310 and the outer structure 320.

The main constituent of the alloy powder may include compound of the main constituent of the metal powder. In this case, the metal that forms the main constituent of the outer structure 320 may be the same as the metal that forms the main constituent of the inner structure 310. This enhances the coupling strength between the outer structure 320 and the inner structure 310.

At step S200, the compression forming and sintering may be simultaneously implemented. For example, the oxidation resistant alloy 300 may be produced by applying compression forming to the first formed member 100 through hot isostatic pressing (HIP) in the state in which the first formed member 100 is covered with the alloy powder.

Embodiment 2

Figure 5:
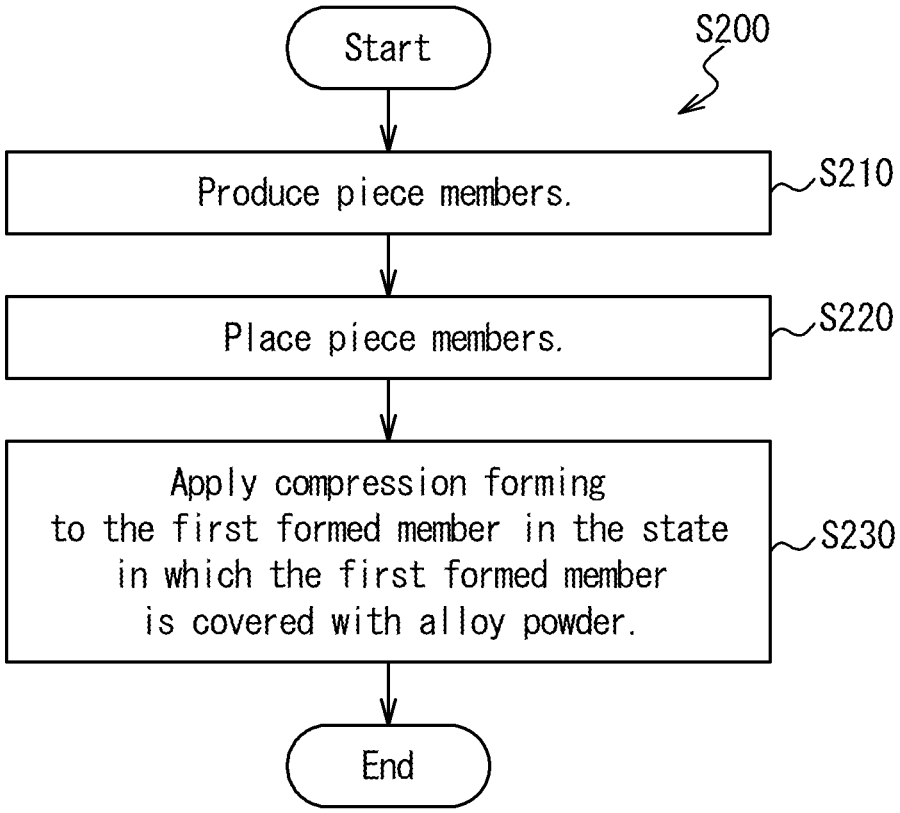
FIG. 5 is a flowchart showing part of a manufacturing method of oxidation resistant alloy, according to one embodiment.
Figure 6:
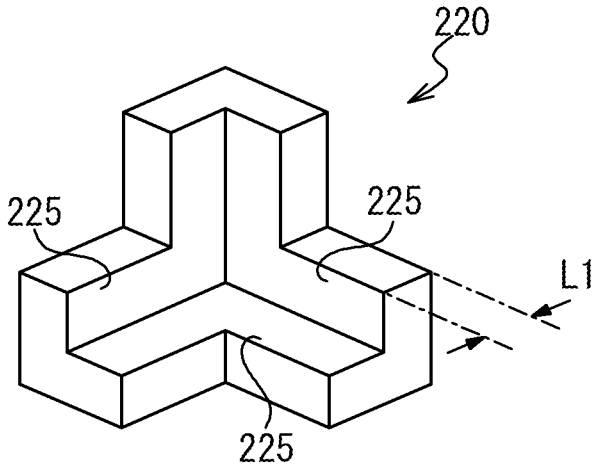
FIG. 6 is a schematic diagram of a piece member, according to one embodiment.

A method shown in FIG. 5 may be implemented at step S200. At step S210, piece members 220 are produced by applying compression forming to alloy powder. As shown in FIG. 6, a piece member 220 has a plurality of contact surfaces 225 which may be placed in contact with the first formed member 100 and is configured such that the piece member 220 can be placed at a corner of the first formed member 100, in embodiments where the first formed member 100 is shaped as a cuboid, for example, at a vertex of the cuboid. The thickness L1 of the piece member 220 may be thinner than the thickness of the outer layer 210. For example, the thickness L1 of the piece members 220 may be 90% or less of the thickness of the outer layer 210. The thickness L1 may be 80% or less of the thickness of the outer layer 210.

The piece members 220 may be produced by implementing the compression forming without melting the alloy powder. For example, the piece members 220 may be formed through cold isostatic pressing (CIP) or molding.

Figure 7:
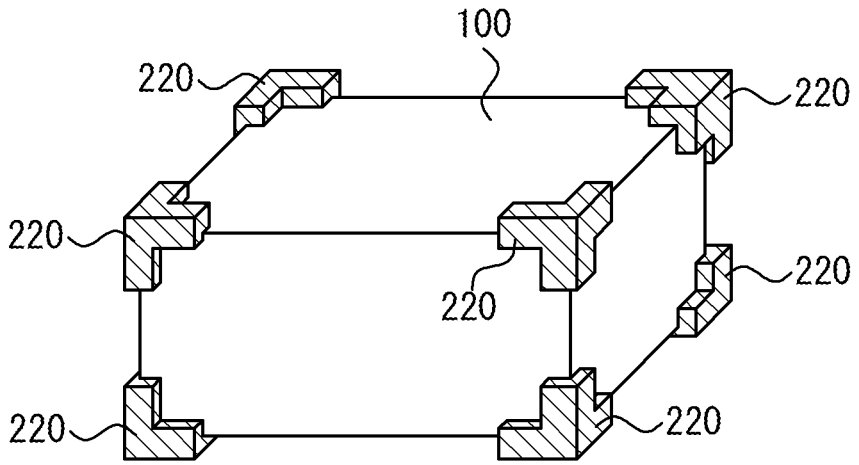
FIG. 7 is a diagram for illustrating a manufacturing process of oxidation resistant alloy, according to one embodiment.
Figure 8:
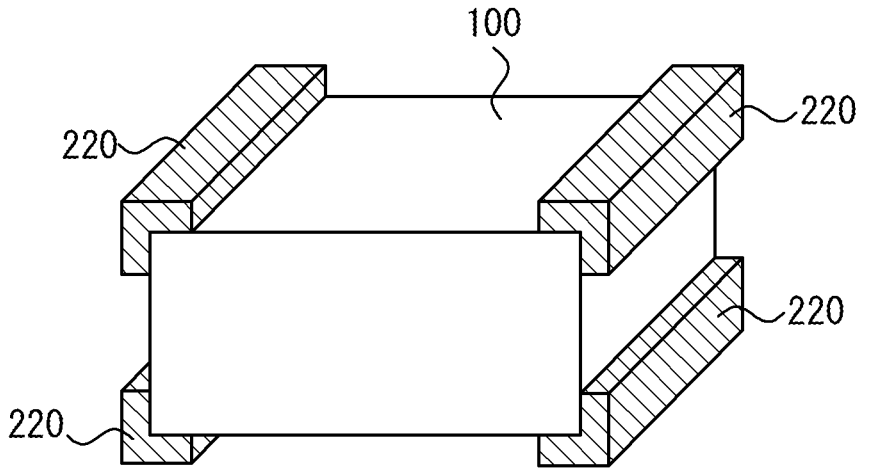
FIG. 8 is a diagram for illustrating a manufacturing process of oxidation resistant alloy, according to one embodiment.

At step S220, as shown in FIG. 7, the piece members 220 are placed to support the first formed member 100. For example, the piece members 220 are placed at at least some of the corners of the first formed member 100. The piece members 220 may be placed at the vertices of the first formed member 100. As shown in FIG. 8, the piece members 220 may be each placed at a boundary between two flat or curved surfaces, for example, along an edge of the cuboid.

At step S230, the oxidation resistant alloy 300 is produced by covering the first formed member 100 with alloy powder and applying compression forming to the first formed member 100 in the state in which the first formed member 100 is covered with the alloy powder. The first formed member 100 is covered with the alloy powder in the state in which the first formed member 100 is supported by the piece members 220. The first formed member 100 covered with the alloy powder is subjected to compression forming.

Figure 9:
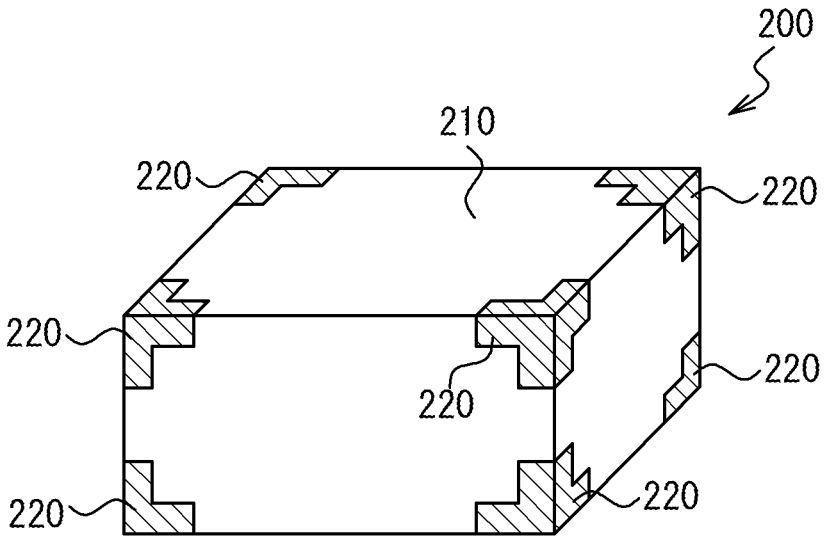
FIG. 9 is a schematic diagram of a second formed member, according to one embodiment.

At step S230, as shown in FIG. 9, a second formed member 200 may be produced by implementing the compression forming without melting the alloy powder. The first formed member 100 is covered with the piece members 220, which are formed of the alloy powder, and the outer layer 210. The second formed member 200 may be produced through cold isostatic pressing or molding. The oxidation resistant alloy 300 is then produced by sintering the second formed member 200 with a desired method.

As thus described, the piece members 220 may be used to manufacture the oxidation resistant alloy 300. By supporting the first formed member 100 with the piece members 220, the outer structure 320 of the oxidization resistant alloy 300 may have an even thickness. This manufacturing method can reduce exposure of the inner structure 310 of the oxidation resistant alloy 300 onto the surface of the oxidation resistant alloy 300.

At step S230, the compression forming and the sintering may be simultaneously implemented. For example, compression forming of the first formed member 100 covered with the alloy powder may be achieved through hot isostatic pressing.

Embodiment 3

Figure 10:
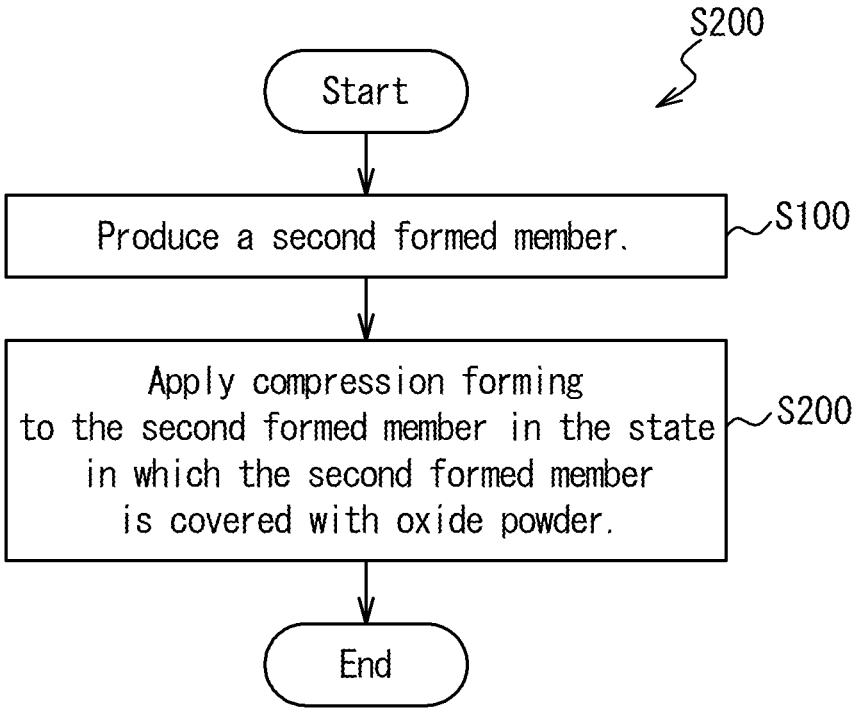
FIG. 10 is a flowchart showing part of a manufacturing method of oxidation resistant alloy, according to one embodiment.

A method shown in FIG. 10 may be implemented at step S200. At step S250, a second formed member 200 is produced by applying compression forming to the first formed member 100 in the state in which the first formed member 100 is covered with the alloy powder. For example, the first formed member 100 is covered with the alloy powder. The second formed member 200 is produced by applying compression forming to the first formed member 100 covered with the alloy powder.

The second formed member 200 may be produced by implementing the compression forming without melting the alloy powder. For example, the second formed member 200 may be produced from the first formed member 100 covered with the alloy powder through cold isostatic pressing or molding.

At step S260, oxidation resistant alloy 300 is produced by applying compression forming to the second formed member 200 in the state in which the second formed member 200 is covered with oxide powder. For example, the second formed member 200 is covered with the oxide powder. The oxide powder may include, for example, part of aluminum oxide ($Al_2O_3$), yttrium oxide ($Y_2O_3$), chromium oxide ($Cr_2O_3$), zirconia ($ZrO_2$), yttrium-stabilized zirconia (YSZ), magnesium oxide (MgO), and hafnium oxide ($HfO_2$).

Figure 11:
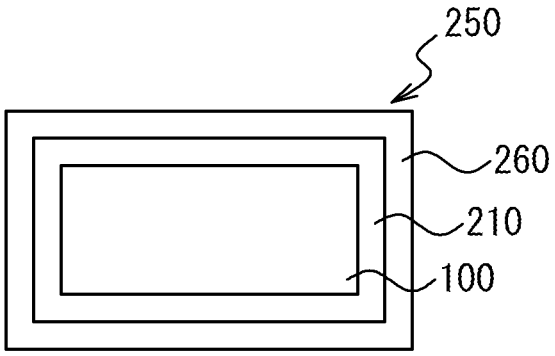
FIG. 11 is a section view of a third formed member, according to one embodiment.

At step S260, as shown in FIG. 11, a third formed member 250 may be produced by implementing the compression forming without melting the oxide powder. The first formed member 100 is covered with an outer layer 210 formed of alloy powder. The second formed member 200, for example, the outer layer 210 is covered with an oxide layer 260 formed of the oxide powder. The second formed member 200 may be entirely covered with the oxide powder. The third formed member 250 may be produced through cold isostatic pressing or molding. Oxidation resistant alloy 300 is then produced by sintering the third formed member 250 with a desired method.

Figure 12:
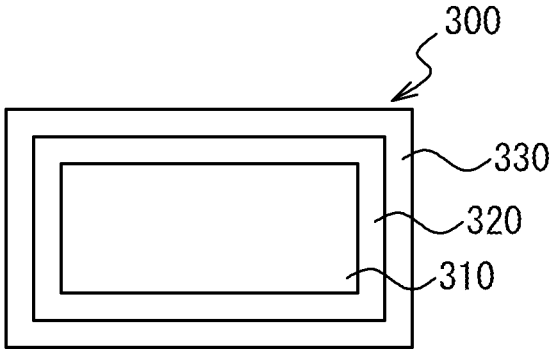
FIG. 12 is a section view of oxidation resistant alloy, according to one embodiment.

As shown in FIG. 12, the oxidation resistant alloy 300 thus manufactured includes an inner structure 310, an outer structure 320, and a surface layer 330. Since the surface layer 330 is formed of oxide, the oxidation resistant alloy 300 exhibits high oxidation resistance. The inner structure 310 and the outer structure 320 are formed in the same way as those of the oxidation resistant alloy 300 shown in FIG. 3, and therefore no description is given here of the inner structure 310 and the outer structure 320. Further, since the oxidation resistant alloy 300 can be manufactured with a single sintering process, the manufacturing cost is reduced.

At step S260, the compression forming and the sintering may be simultaneously implemented. For example, compression forming of the second formed member 200 covered with the oxide powder may be achieved through hot isostatic pressing.

Embodiment 4

A process shown in FIG. 10 may be performed in step S230 shown in FIG. 5. In this case, at step 250, the first formed member 100 is covered with alloy powder in the state in which the first formed member 100 is supported by the piece members 220, and the first formed member 100 covered with the alloy powder is subjected to compression forming to produce the second formed member 200. The subsequent process is the same as that of embodiment 3, and therefore no description of the subsequent process is given here.

Embodiment 5

Figure 13:
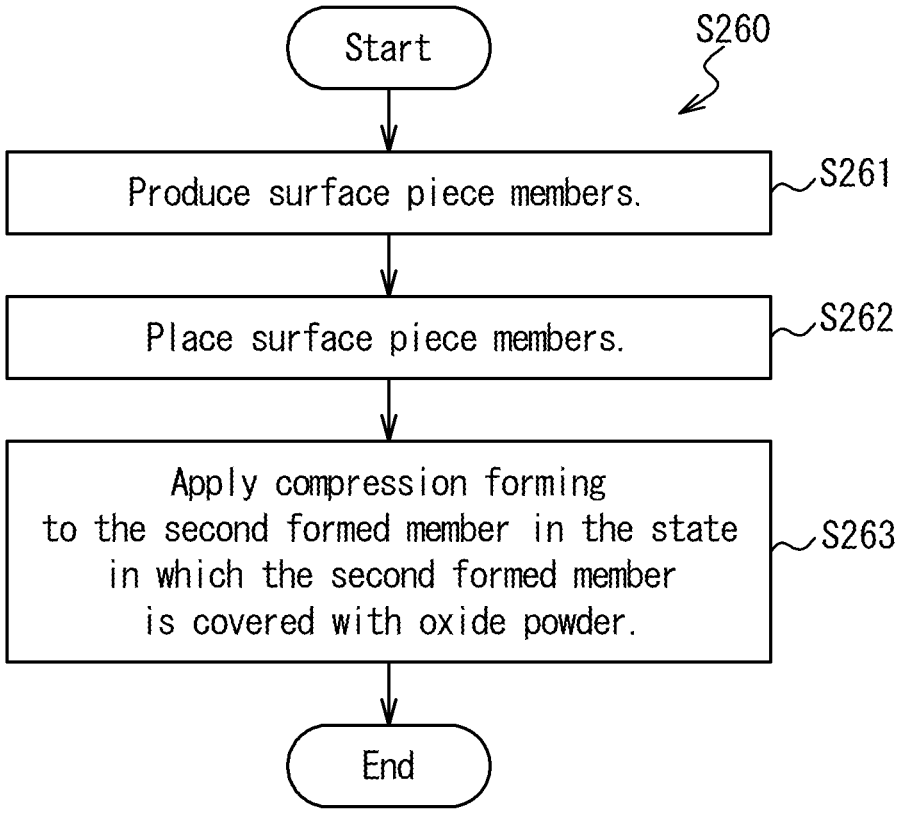
FIG. 13 is a flowchart showing part of a manufacturing method of oxidation resistant alloy, according to one embodiment.
Figure 14:
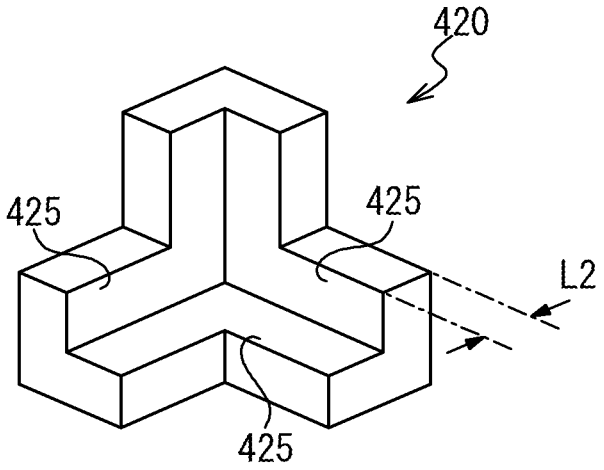
FIG. 14 is a schematic diagram of a surface piece member, according to one embodiment.

A process shown in FIG. 13 may be implemented at step S260 shown in FIG. 10. At step 261, as shown in FIG. 14, surface piece members 420 are formed by applying compression forming to oxide powder. A surface pixel member 420 has a plurality of contact surfaces 425 that may be placed in contact with the second formed member 200 and is configured such that the surface piece member 420 can be placed at a corner of the second formed member 200. The thickness L2 of the surface piece member 420 may be thinner than the thickness of the oxidation layer 260. For example, the thickness L2 of the surface piece member 420 may be 90% or less of the thickness of the oxide layer 260. The thickness L2 may be 80% or less of the thickness of the oxide layer 260.

The surface piece members 420 may be produced by implementing the compression forming without melting the oxide powder. For example, the surface piece members 420 may be formed through cold isostatic pressing (CIP) or molding.

Figure 15:
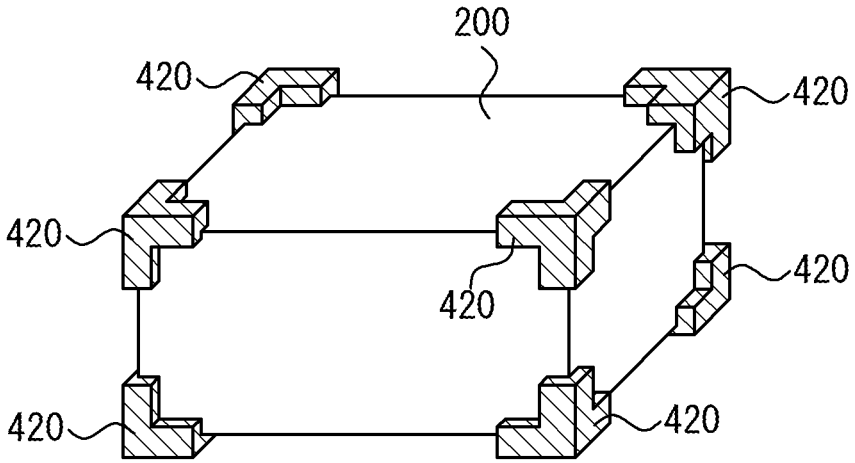
FIG. 15 is a diagram for illustrating a manufacturing process of oxidation resistant alloy, according to one embodiment.

At step S262, as shown in FIG. 15, the surface piece members 420 are placed to support the second formed member 200. For example, the surface piece members 420 are placed at at least some of the corners of the second formed member 200. The surface piece members 420 may be placed at the vertices of the second formed member 200.

At step S263, oxidation resistant alloy 300 is produced by covering the second formed member 200 with oxide powder and applying compression forming to the second formed member 200 covered with the oxide powder. The second formed member 200 is covered with the oxide powder in the state in which the second formed member 200 is supported by the surface piece members 420. The second formed member 200 covered with the oxide powder is subjected to compression forming.

At step S263, a third formed member 250 may be produced by implementing compression forming without melting the oxide powder. The second formed member 200 is covered with surface piece members 420 and oxide powder, where the surface piece members 420 are formed of oxide powder. The third formed member 250 may be produced through cold isostatic pressing or molding. Oxidation resistant alloy 300 may be then produced by sintering the third formed member 250 with a desired method.

As thus described, the oxidation resistant alloy 300 may be manufactured using the surface piece members 420. By supporting the second formed member 200 with the surface piece members 420, the surface layer 330 of the oxidation resistant alloy 300 may have an even thickness. This manufacturing method can reduce exposure of the outer structure 320 and the inner structure 310 of the oxidation resistant alloy 300 onto the surface of the oxidation resistant alloy 300.

At step 263, the compression forming and the sintering may be simultaneously implemented. For example, compression forming of the second formed member 200 covered with the oxide powder may be achieved by hot isostatic pressing.

Modification Examples

Figure 16:
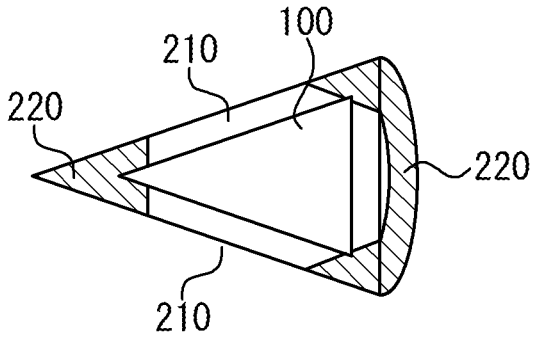
FIG. 16 is a perspective section view of a second formed member, according to one embodiment.

The oxidization resistant alloy 300 may be manufactured in any shapes achievable with compression forming. For example, the oxidation resistant alloy 300 may be manufactured in a conical shape. In this case, as shown in FIG. 16, piece members 220 may be disposed at the vertex of the cone and along the edge between the base and the side surface.

The oxidation resistant alloy 300 may include a multi-layered outer structure 320. For example, the outer structure 320 may be configured such that the closer the layers are to the surface of the oxidation resistant alloy 300, the higher oxidation resistances the layers exhibit. Such oxidation resistant alloy 300 may be manufactured by repeating step S200 of FIG. 1. In this case, the sintering process may be performed after all the layers are formed through compression forming. For example, the respective layers are subjected to compression forming without melting the alloy powder. The sintering process is implemented after all the layers are formed through compression forming without melting the alloy powder. If sintering and compression forming are repeated, this may make the layered outer structure 320 brittle and fragile compared to the inner structure 310. By implementing the sintering process after forming the layered outer structure 320 through compression forming, it is possible to manufacture the oxidation resistant alloy 300 without destroying the layered structure.

The metal powder may include an element that can reinforce the first metal by doping, for example, titanium (Ti), zirconium (Zr), hafnium (Hf), tungsten (W), tantalum (Ta), carbon (C), or the like. This provides higher strength for the oxidation resistant alloy 300.

The metal powder may include the main constituent of the alloy powder that covers the first formed member 100. This makes it easy to bond the inner structure 310 to the outer structure 320.

The alloy powder or the oxidation powder may include an element that reacts to oxygen more easily than the main constituent of the first formed member 100 (e.g., the element with the highest mass percentage concentration in the first formed member 100), such as, aluminum (Al), magnesium (Mg), calcium (Ca), niobium (Nb), chromium (Cr), titanium (Ti), rare-earth elements, or the like. This provides higher oxidation resistance to the oxidation resistant alloy 300.

The surface layer 330 may be formed of ceramics. In this case, the oxidation resistant alloy 300 is produced by applying compression forming to the second formed member 200 at step S260 shown in FIG. 10 in the state in which the second formed member 200 is covered with ceramic precursor powder. The process is similar to those in Embodiments 3-4 except for that the ceramic precursor powder is used in place of the oxide powder, and therefore no description of the process is given here. Also, the surface piece members 420 may be formed through compression forming of ceramic precursor powder at step S261 of FIG. 13. The process is similar to that of Embodiment 5 except for that the ceramic precursor powder is used in place of the oxide powder, and therefore no description of the process is given here.

The above-described embodiments and modification examples are construed as mere examples and may be modified as long as the function is not disturbed. Further, the configurations described in the respective embodiments and modification examples may be arbitrarily modified and/or combined as long as the function is not disturbed.

Manufacturing methods of oxidation resistant alloy described in the respective embodiments can be represented, for example, as follows.

A manufacturing method of oxidation resistant alloy according to a first aspect includes: producing (S100) a first formed member (100) by applying compression forming to metal powder; and applying compression forming (S200) to the first formed member (100) in a state in which the first formed member is covered with alloy powder different from the metal powder. The oxidation resistance of a major constituent of the alloy powder is higher than oxidation resistance of a major constituent of the metal powder.

The oxidation resistant alloy (300) thus manufactured includes an inner structure (310) and an outer structure (320) that covers the inner structure (310) while the oxidation resistance of the outer structure (320) is higher than the oxidation resistance of the inner structure (310). Accordingly, the oxidation resistant alloy (300) thus manufactured exhibits high oxidation resistance.

The manufacturing method according to a second aspect is a variation of the manufacturing method according to the first aspect. In the manufacturing method according to the second aspect, producing the first formed member (100) includes applying the compression forming to the metal powder without melting the metal powder.

Since the first formed member (100) is a non-sintered body formed without being sintered, the manufacturing cost can be reduced.

The manufacturing method according to a third aspect is a variation of the manufacturing method according to the first aspect. In the manufacturing method according to the third aspect, applying the compression forming (S200) to the first formed member (100) includes: producing a second formed member (200) by applying compression forming to the alloy powder without melting the alloy powder; and sintering the second formed member.

The manufacturing method of oxidation resistant alloy according to a fourth aspect is a variation of the manufacturing method according to the first aspect. In the manufacturing method according to the fourth aspect, applying the compression forming (S200) to the first formed member (100) includes: producing (S210) a piece member (220) through compression forming of the alloy powder; and supporting (S220) the first formed member (100) with the piece member (220). Applying the compression forming (S200) to the first formed member (100) further includes covering (S230) the first formed member (100) with the alloy powder.

The manufacturing method of oxidation resistant alloy according to a fifth aspect is a variation of the manufacturing method according to the fourth aspect. In the manufacturing method according to the fifth aspect, supporting (S220) the first formed member (100) includes placing the piece member (220) at a corner of the first formed member (100).

This may allow the outer structure (320) to have an even thickness. Accordingly, it is possible to reduce exposure of the inner structure (310) onto the surface of the oxidation resistant alloy (300).

The manufacturing method according to a sixth aspect is a variation of the manufacturing method according to the fourth aspect. In the manufacturing method according to the sixth aspect, producing the piece member (220) includes implementing the compression forming to the alloy powder without melting the alloy powder.

Since the piece member (220) is formed without being sintered, the manufacture cost can be reduced.

The manufacturing method of oxidation resistant alloy according to a seventh aspect is a variation of the manufacturing method according to the first aspect. In the manufacturing method according to the seventh aspect, the main constituent of the metal powder includes first metal, and the main constituent of the alloy powder includes compound of the first metal.

The manufacturing method of oxidation resistant alloy according to an eighth aspect is a variation of the manufacturing method according to the first aspect. In the manufacturing method according to the eighth aspect, the metal powder includes the main constituent of the alloy powder.

This enhances the coupling strength between the inner structure (310) and the outer structure (320).

The manufacturing method of oxidation resistant metal according to a ninth aspect is a variation of the manufacturing method according to the first aspect. In the manufacturing method according to the ninth aspect, applying compression forming (S200) to the first formed member (100) includes entirely covering the first formed member (100) with the alloy powder.

The manufacturing method of oxidation resistant alloy according to a tenth aspect is a variation of the manufacturing method according to the first aspect. In the manufacturing method according to the tenth aspect, applying compression forming (S200) to the first formed member (100) includes: producing a second formed member (200) by applying compression forming to the first formed member (100) in the state in which the first formed member is covered with the alloy powder; and applying compression forming (S260) to the second formed member (200) in a state in which the second formed member is covered with oxide powder or ceramic precursor powder.

The oxidation resistant alloy (300) thus manufactured includes a surface layer (330). Since the surface layer (330), which exhibits high oxidation resistance, covers the outer structure (320), the oxidation resistant alloy (300) can have high oxidation resistance.

Oxidation resistant alloys described in the respective embodiments can be represented, for example, as follows.

Oxidation resistant alloy according to an eleventh aspect includes: an inner structure (310) that includes first metal as a main constituent; and an outer structure (320) containing an element that forms compound with the first metal, the outer structure covering the inner structure. In the outer structure (320), a distribution of the element that forms the compound with the first metal is even in a thickness direction of the outer structure (320). The concentration of the compound of the first metal in the outer structure (320) is different from the concentration of the compound of the first metal in the inner structure (310). The outer structure (320) has a plurality of voids (322) with aspect ratios of 1.3 or less.

With the above-described manufacturing methods, oxidation resistant alloy (300) thus configured is manufactured. The manufactured oxidation resistant alloy (300) exhibits high oxidation resistance.

The present application claims priority to Japanese patent application No. 2020-057413, filed on Mar. 27, 2020, the disclosure of which is incorporated herein by reference in its entirety.

What is claimed is:

1. A manufacturing method of oxidation resistant alloy, the method comprising:

producing a first formed member by applying compression forming to metal powder; and applying compression forming to the first formed member in a state in which the first formed member is covered with alloy powder different from the metal powder, wherein applying the compression forming to the first formed member comprises entirely covering the first formed member with the alloy powder, wherein applying the compression forming to the first formed member comprises:

producing a piece member through compression forming to the alloy powder;

supporting the first formed member with the piece member by placing the piece member at at least some of corners of the first formed member or at a boundary between two flat or curved surfaces of the first formed member; and covering the first formed member with the piece member and an outer layer, the piece member and the outer layer being formed of the alloy powder, by covering the first formed member supported by the piece member with the alloy powder, and wherein oxidation resistance of a major constituent of the alloy powder is higher than oxidation resistance of a major constituent of the metal powder.

2. The manufacturing method according to claim 1, wherein producing the first formed member comprises applying the compression forming to the metal powder without melting the metal powder.

3. The manufacturing method according to claim 1, wherein applying the compression forming to the first formed member comprises:

producing a second formed member by applying compression forming to the alloy powder without melting the alloy powder; and sintering the second formed member.

4. The manufacturing method according to claim 1, wherein supporting the first formed member comprises placing the piece member at a corner of the first formed member.

5. The manufacturing method according to claim 1, wherein producing the piece member comprises implementing the compression forming to the alloy powder without melting the alloy powder.

6. The manufacturing method according to claim 1, wherein the main constituent of the metal powder comprises first metal, and wherein the main constituent of the alloy powder comprises compound of the first metal.

7. The manufacturing method according to claim 1, wherein the metal powder comprises the main constituent of the alloy powder.

8. The manufacturing method according to claim 1, wherein applying the compression forming to the first formed member comprises:

producing a second formed member by applying compression forming to the first formed member in the state in which the first formed member is covered with the alloy powder; and applying compression forming to the second formed member in a state in which the second formed member is covered with oxide powder or ceramic precursor powder.

9. The manufacturing method according to claim 1, wherein the constitute of the metal powder is selected from a group including molybdenum (Mo), niobium (Nb), tungsten (W), a metal-silicon-based alloy and a metal boron- based alloy, and wherein a metal of the metal-silicon-based alloy and a metal of the metal boron-based alloy include molybdenum (Mo), niobium (Nb), or tungsten (W).

10. The manufacturing method according to claim 1, wherein the constitute of the alloy powder includes oxidation resistant metal-silicon-boron-based alloy, and wherein the metal-silicon-boron-based alloy includes molybdenum (Mo), niobium (Nb), or tungsten (W).

* * * * *